US006825430B2

(12) United States Patent
Wong et al.

(10) Patent No.: US 6,825,430 B2
(45) Date of Patent: Nov. 30, 2004

(54) ELECTRICAL SWITCH

(76) Inventors: Memie Mei Mei Wong, 7th Floor, Block 2, Leader Industrial Centre, 188-202 Texaco Road, Tsuen Wan, New Territories (HK); Sam Yun Sum Wong, 7th Floor, Block 2, Leader Industrial Centre, 188-202 Texaco Road, Tsuen Wan, New Territories (HK)

( * ) Notice: Subject to any disclaimer, the term of this patent is extended or adjusted under 35 U.S.C. 154(b) by 0 days.

(21) Appl. No.: 10/408,567

(22) Filed: Apr. 8, 2003

(65) Prior Publication Data

US 2004/0200713 A1 Oct. 14, 2004

(51) Int. Cl.[7] ..... H01H 1/00
(52) U.S. Cl. ..... 200/547; 200/6 C
(58) Field of Search ..... 200/277, 536, 200/540, 537, 547–550, 563, 565, 16 R–16 F

(56) References Cited

U.S. PATENT DOCUMENTS 2,521,468 A * 9/1950 Gilbert ..... 200/432
2,831,081 A * 4/1958 Mason ..... 200/414
3,542,975 A * 11/1970 Walterick ..... 200/5 F
3,858,021 A * 12/1974 Brandlein ..... 200/277.1
3,971,905 A * 7/1976 Delaage ..... 200/432
4,485,280 A * 11/1984 Matsubara et al. ..... 200/16 C
4,642,427 A * 2/1987 Kratz et al. ..... 200/16 C
4,841,085 A * 6/1989 Farquhar et al. ..... 558/180
5,422,452 A * 6/1995 Chang et al. ..... 200/277

* cited by examiner

*Primary Examiner*—Michael Friedhofer
*Assistant Examiner*—Lisa Klaus
(74) *Attorney, Agent, or Firm*—Leydig, Voit & Mayer, Ltd.

(57) ABSTRACT

An electrical slide switch having a housing, four fixed contacts, a switching member supported for limited reciprocating rotary movement, and two moving contacts supported by the switching member for movement into and out of contact with the fixed contacts. An actuator is supported by the housing for linear sliding movement moving the switching member. Two of four fixed contacts are located on one side of the switching member and the other two fixed contacts are located on the opposite side of the switching member. Each moving contact has a first part for electrically inter-connecting a respective pair of the fixed contacts on opposite sides of the switching member in a first position and a second part for electrically inter-connecting a respective pair of the fixed contacts on the same side of the switching member in a second position, producing a reversal of electrical contact interconnections.

28 Claims, 7 Drawing Sheets

ELECTRICAL SWITCH

The present invention relates to an electrical switch that can, particularly but not exclusively, perform a changeover switching action.

BACKGROUND OF THE INVENTION

Electrical slide switches and changeover switches are of course widely known. In general, slide switches incorporate a sliding actuator for operation, and changeover switches are for rearranging the connection in an electrical circuit for example to reverse the direction of an electric motor.

Changeover switches for this purpose, such as those used in a ceiling fan, are often implemented by a slide switch. In a typical construction, the slide switch has six terminals arranged in two rows of three, and the two pairs of diagonally opposite terminals are each externally short-circuited, thereby resulting in a set of four terminals, as is normally required, for changeover connection/switching.

The use of a slide switch of this type for changeover connection is not ideal as two out of the six terminals are wasted. This does not only have an adverse effect on the production cost and physical size of the switch, but also introduces complication to the use and connection of the switch or a burden to productivity.

In another aspect, slide switches usually have a number of stable switching positions that are defined by resilient means co-acting between the switch body and an actuator. Such means typically take the form of a plunger biassed by a compression coil spring to bear against a wavy track, along which the plunger is slidable. Such a spring action often interferes with the contact making/breaking between the switch contacts, whereby the performance of the switch, especially during switching, may be affected in terms of, for example, contact pressure and user's feel of switching.

The present invention seeks to obviate or to at least alleviate such shortcomings by providing an improved electrical switch.

SUMMARY OF THE INVENTION

According to a first aspect of the invention, there is provided an electrical slide switch comprising a housing, a plurality of fixed contacts located in the housing, and a switching member supported in the housing for limited reciprocating rotary movement about an axis. At least one moving contact is supported by the switching member for movement to come into and out of contact with the fixed contacts. Also included is an actuator supported by the housing for sliding movement to move the switching member.

Preferably, the actuator is supported for substantially linear sliding movement.

It is preferred that the actuator is supported for sliding movement in a direction substantially perpendicular to the axis.

Preferably, the actuator is in engagement with the switching member through a sliding hinge connection.

It is preferred that the switching member has a substantially cylindrical body that is pivotable about the axis and includes a lateral projection engaged by the actuator.

It is further preferred that the actuator includes an aperture slidably engaging the projection.

Advantageously, the switching member has a substantially cylindrical body pivotable about the axis, and the moving contact extends over an angle exceeding 180° round the body, thereby self-gripping the body.

In a specific construction, the switching member has a substantially cylindrical surface around the axis, and the moving contact is located in that surface and lies substantially flush therewith for smooth contact with the fixed contacts.

Specifically, the housing has opposite walls including a pair of mutually aligned recesses, and the switching member has opposite ends slotted into the recesses respectively, whereby the switching member is supported.

In a preferred embodiment, the electrical slide switch includes four said fixed contacts, with two on one side and the other two on the opposite side of the switching member, and includes two said moving contacts supported on the switching member. Each moving contact has a first part for electrically inter-connecting a respective pair of the fixed contacts on opposite sides of the switching member in a first position and includes a second part for electrically interconnecting a respective pair of the fixed contacts on the same side of the switching member in a second position.

More preferably, the switching member has a substantially cylindrical body having opposite ends and pivotable about the axis, and the first part of each moving contact extends partially around the body and the second part extends from one end to the opposite end of the body.

Further more preferably, the two parts of each moving contact together are substantially T-shaped.

In a specific construction, each fixed contact comprises a resiliently deformable strip having a first end for contact with the moving contact and a second end for connection with an electrical cable. The second end is folded back in to form a clamp with an adjacent part of the strip for automatically clamping an end of said cable upon entry.

More specifically, the contact strip has a generally right-angled triangular configuration, having an inclined upper section including the first end, a lower section including the second end, and a middle section including the said part.

In a preferred embodiment, the housing has a part engaging the actuator, and one of the actuator and housing part includes a protuberance and the other of the actuator and housing part includes a series of indentations. The protuberance is slidably engageable selectively with the indentations by virtue of resilience to define respective distinct stable positions of the actuator.

More preferably, the protuberance is engageable with the indentations in a direction that is substantially perpendicular to the direction in which the moving contact contacts the fixed contacts.

Further more preferably, the moving contact contacts the fixed contacts substantially along an imaginary vertical plane, and the protuberance is engageable with the indentations in a substantially horizontal direction.

It is preferred that the actuator includes two said protuberances on opposite sides, and the housing part includes two said series of indentations on opposite sides for selective engagement by the corresponding protuberances.

More preferably, the housing part has a pair of depending flanges each including on its inner side the corresponding series of indentations.

It is preferred that the protuberance is resiliently biassed into engagement selectively with the series of indentations.

It is further preferred that the protuberance comprises a free end of a finger that is resiliently deflectable.

It is further preferred that the actuator includes two said fingers on opposite sides and extending in opposite directions therealong.

According to a second aspect of the invention, there is provided an electrical switch comprising a housing, a switching member supported in the housing for reciprocating movement, and four fixed contacts located in the housing with two adjacent one side and the other two adjacent the opposite side of the switching member. Two moving contact means are supported by the switching member for movement to come into and out of contact with the fixed contacts. Also included is an actuator supported by the housing for sliding movement to move the switching member. Each moving contact means has a first part for electrically interconnecting a respective pair of the fixed contacts on opposite sides of the switching member in a first position and includes a second part for electrically inter-connecting a respective pair of the fixed contacts on the same side of the switching member in a second position.

Preferably, the switching member is supported for limited reciprocating rotary movement about an axis.

Preferably, the actuator is supported for substantially linear sliding movement.

According to a third aspect of the invention, there is provided an electrical switch comprising a housing, a plurality of fixed contacts located in the housing, and a switching member supported in the housing for reciprocating movement. At least one moving contact is movable by the switching member to come into and out of contact with the fixed contacts in a first direction. Also included is an actuator, supported by the housing for sliding movement to move the switching member, the housing having a part engaging the actuator. One of the actuator and housing part includes a protuberance and the other of the actuator and housing part includes a series of indentations. The protuberance is slidably engageable selectively with the indentations by virtue of resilience to define respective distinct stable positions of the actuator. The protuberance is engageable with the indentations in a second direction that is substantially perpendicular to the first direction.

Preferably, the protuberance is engageable with the indentations in a direction that is substantially perpendicular to the direction in which the moving contact contacts the fixed contacts.

More preferably, the moving contact contacts the fixed contacts substantially along an imaginary vertical plane, and the protuberance is engageable with the indentations in a substantially horizontal direction.

It is preferred that the actuator includes two said protuberances on opposite sides, and the housing part includes two said series of indentations on opposite sides for selective engagement by the corresponding protuberances.

It is further preferred that the housing part has a pair of depending flanges each including on its inner side the corresponding series of indentations.

Preferably, the protuberance is resiliently biassed into engagement selectively with the series of indentations.

More preferably, the protuberance comprises a free end of a finger that is resiliently deflectable.

Further more preferably, the actuator includes two said fingers on opposite sides and extending in opposite directions therealong.

BRIEF DESCRIPTION OF DRAWINGS

The invention will now be more particularly described, by way of example only, with reference to the accompanying drawings, in which:

FIGS. 3-1 to 3-9 are sequential top perspective views illustrating assembly of the electrical switch of FIG. 1;

FIGS. 4-1 to 4-3 are sequential top perspective views illustrating assembly of a switching member of the electrical switch of FIG. 1;

FIG. 7 is a top plan view of the electrical switch of FIG. 1 in the first switching position;

FIG. 8 is a top plan view of the electrical switch of FIG. 1 in the second switching position;

DETAILED DESCRIPTION OF PREFERRED EMBODIMENT

Figure 1:
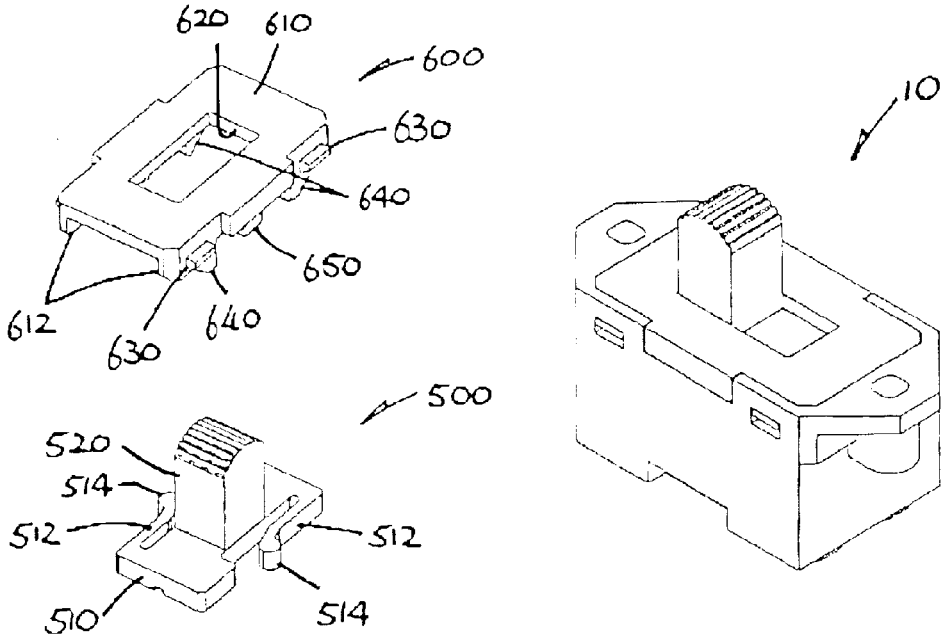
FIG. 1 is a top perspective view of an embodiment of an electrical switch in accordance with the invention.

Referring to the drawings, there is shown an electrical switch 10 embodying the invention, which is a slide switch having an oblong generally rectangular plastic housing 100 that includes a rectangular plastic top lid 606 closing the housing 100. Housed in the housing 100 are four identical fixed contacts 200 located at respective corners C4, and a central switching member 300 bearing a pair of identical moving contacts 400 supported for limited rotary movement about a horizontal axis X1. A plastic actuator 500 is supported by the housing 100 and is slidable linearly relative thereto for pivoting the switching member 300, thereby bringing the moving contacts 400 into and out of contact with the fixed contacts 200.

The housing 100 has left and right side walls 110, two opposite end walls 120 and a base wall 130, and includes a central partition 140 that separates the left and right corners C4 at each end. Each end wall 120 includes an apertured ear 122 for fixing by a screw to an electrical appliance. The partition 140 is broken over its middle one-third section to define a central room R1 for the switching member 300. The side walls 110 are formed, on their inner surfaces, with a pair of mutually aligned vertical U-shaped slots 112 centrally on opposite sides of the room R1. Each side wall 110 includes two small holes 114 at the top corners thereof for securing the lid 600. The base wall 130 has a pair of transversely-extending ribs 132 that separate the floor between the corners C4 at each end and the room R1, and includes a small hole 134 at the bottom of each corner C4.

The fixed contacts 200 are provided by respective copper strips 210 that are resiliently deformable and are bent into a generally right-angled triangular configuration. Each fixed contact 200 has a 45° downwardly inclined upper section 212 facing the room R1 and a horizontal lower section 214 that is folded back in to point at a vertical middle section 216. The bottom of each corner C4, as defined by the relevant rib 132, is sized such that the corresponding lower section 214 can simply be pushed fitted therein (FIG. 3-2), whereby the copper strip 210 is located.

The bottom layer of the lower contact section 214 has a small hole 218 aligned with the hole 134 of the associated corner C4, through both of which holes 134 and 218 an electrical cable (not shown) can be inserted into the housing 100 from below. Upon entry, the cable end will automatically be clamped firmly by the free end of the top layer of the lower section 214 against the middle section 216 in an inward direction, as the top layer is jammed by the cable end to bend slightly upwards against its resilience.

The switching member 300 has a horizontal-lying plastic cylindrically tubular body 310 that has opposite ends 312 of a slightly reduced diameter and a lateral arm 314 projecting radially upwards centrally from its upper side. A pair of identical shallow arcuate T-shaped recesses 316 is formed symmetrically in the cylindrical surface of the body 310, on diametrically opposite sides thereof and pointing in opposite axial directions, for locating the moving contacts 400 symmetrically on the body 310.

Figure 2:
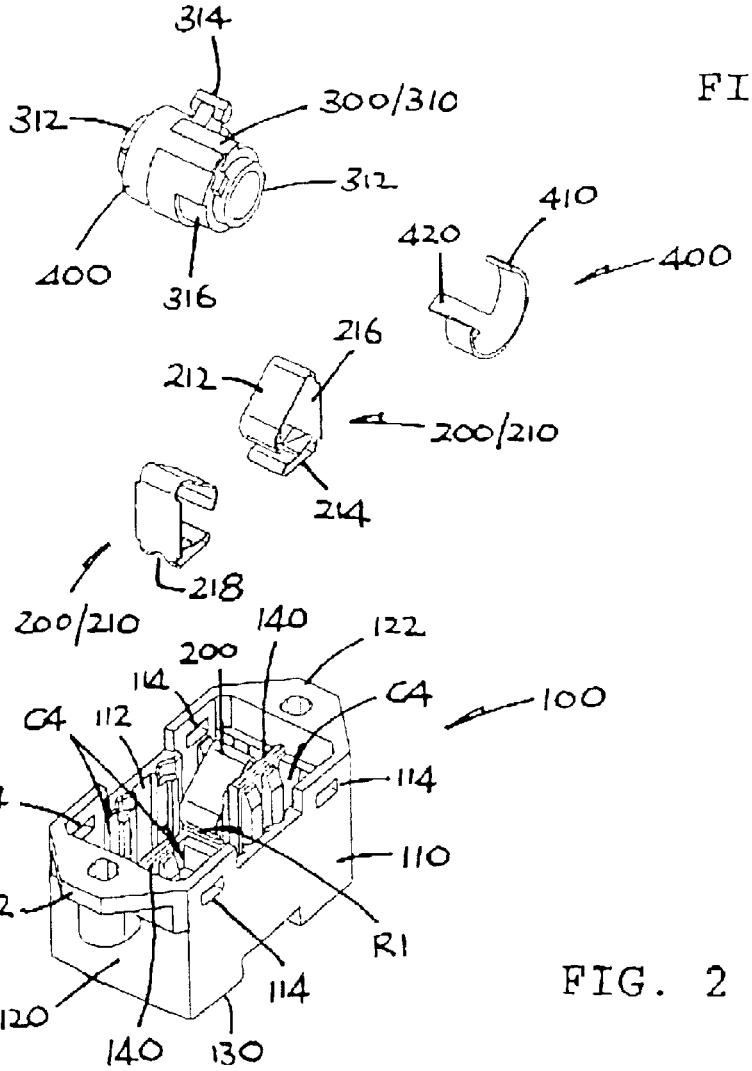
FIG. 2 is an exposed top perspective view of the electrical switch of FIG. 1.

Each moving contact 400 is provided by an arcuate T-shaped copper strip that is inserted laterally into the corresponding recess 316 and fits snugly therein. The moving contact 400 has an arcuate cross limb 410 and a straight central limb 420. The cross limb 410 is bent into part of a circle that extends over an angle of about 270° partially around near a respective end 312 of the switching member body 310, whilst the central limb 420 extends from there to near the opposite end 312. The cross limb 410 extends over an angle exceeding 180°, thereby self-gripping the body 310. The other copper strip 400 is inserted in the opposite axial direction (FIG. 4-2). Both moving contacts 400 are in-laid in the recesses 316 and lie flush with the switching member 300, together providing a non-obstructive surface for smooth contact by the fixed contacts 200.

Figures 1, 3:
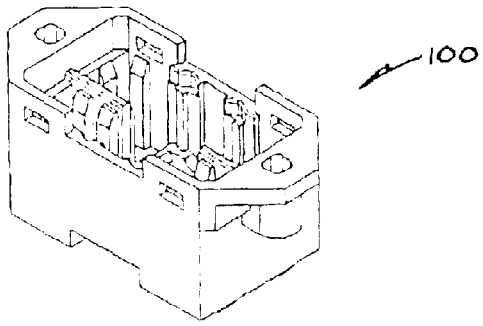
Figures 3, 4:
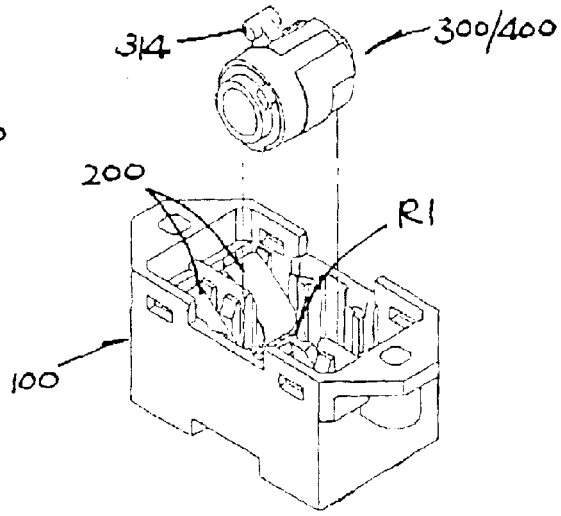
Figures 2, 3:
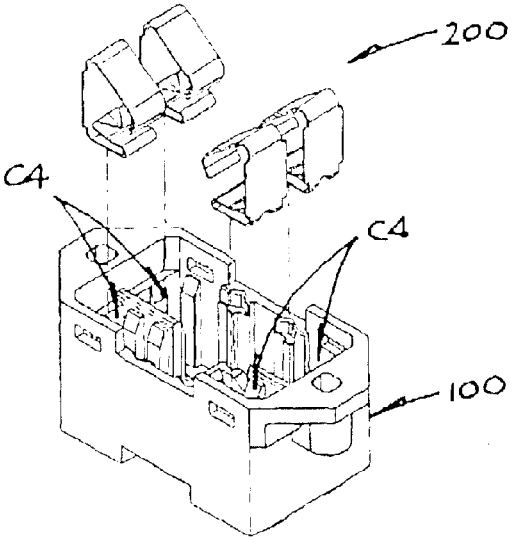
Figures 3, 4, 5:
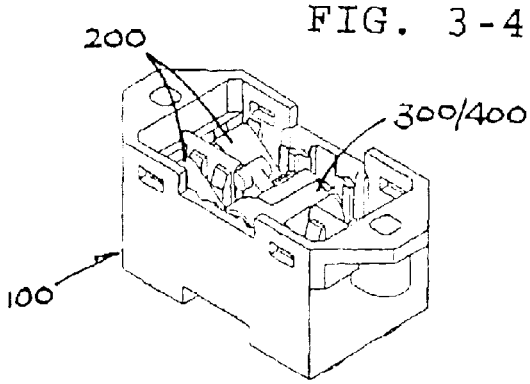
Figure 3:
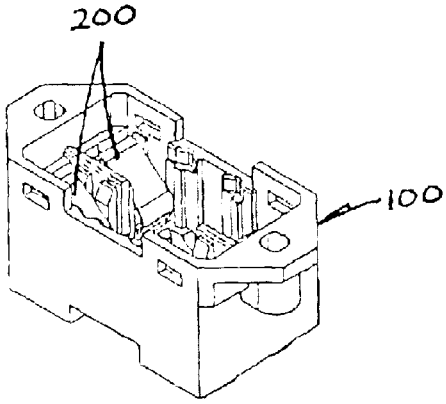
Figures 3, 4, 5, 6:
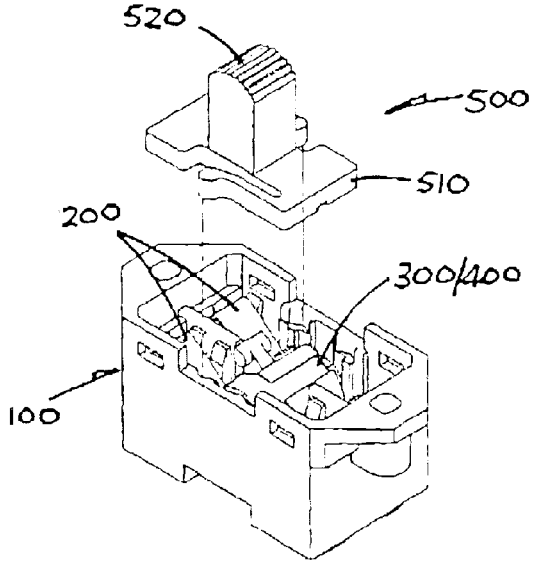
Figures 3, 4, 5, 6, 7:
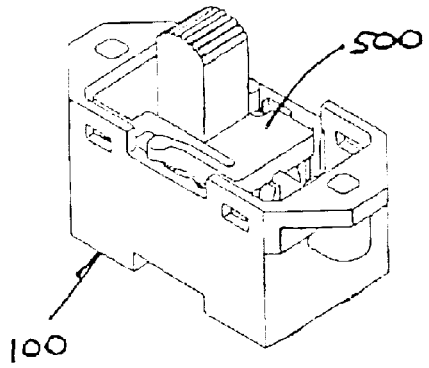
Figures 1, 4:
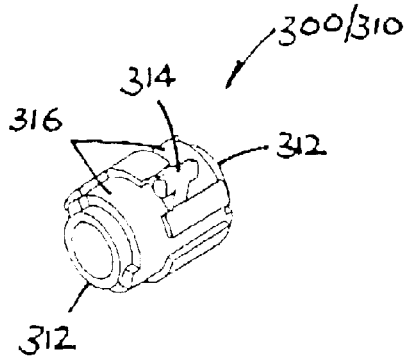
Figures 3, 4, 5, 6, 7, 8:
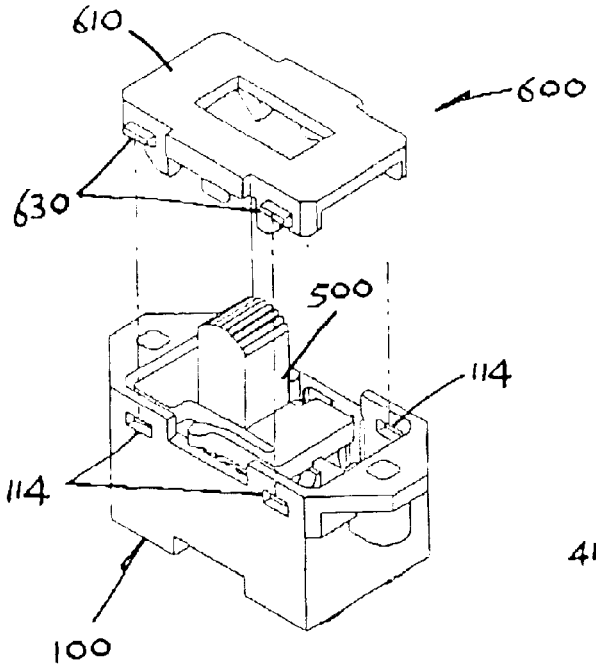
Figures 2, 4:
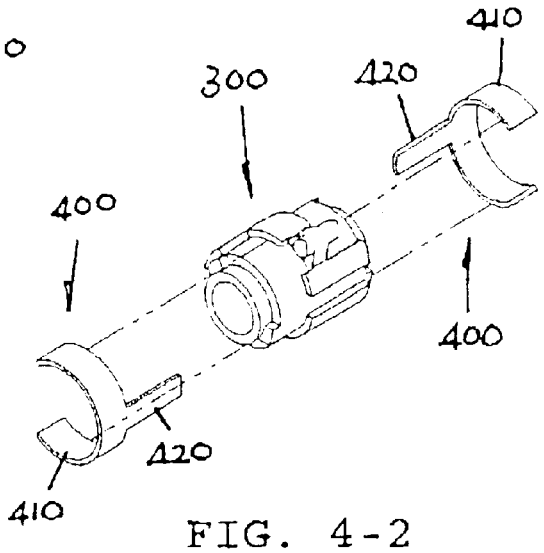
Figures 3, 4, 5, 6, 7, 8, 9:
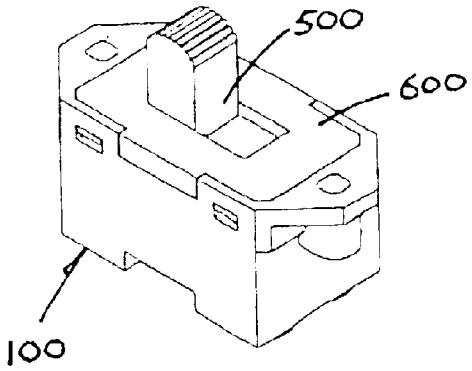
Figures 3, 4:
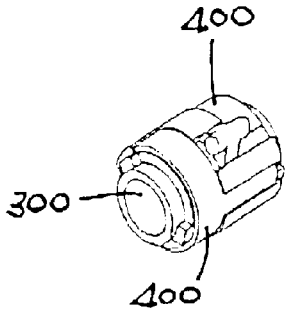

The switching member 300 is lowered into the housing room R1, with its opposite ends 312 slotted into respective slots 112 of the left and right side walls 100 (FIG. 3-4). The slots 112 support the switching member 300 for rotation about the axis X1 that extends transversely of the housing 100. The switching member 300 jams in centrally between the fixed contacts 200 on opposite sides, whereby the upper contact sections 212 bear, with their free ends, resiliently against the combined surface of the switching member 300 and moving contacts 400 for contact with the latter in substantially diametrically opposite directions. The moving/fixed contact action takes place in opposite directions horizontally, along an imaginary vertical plane, parallel to the longitudinal extent of the housing 100.

The actuator 500 has a rectangular base plate 510 and a central operating knob 520 upstanding therefrom. Each of opposite left and right sides of the base plate 510 is formed with a resiliently deflectable finger 512 that extends parallel to that side and lie within its perimeter. Each finger 512 has a tail end integral with a corner of the base plate 510 and a free end that turns and protrudes laterally at mid-length thereof acting as a springy protuberance 514 by virtue of inherent resilience of the finger 512. The other finger 512 points in the opposite direction for balance. The knob 520 is hollow, including a central bottom opening 522.

Figure 7:
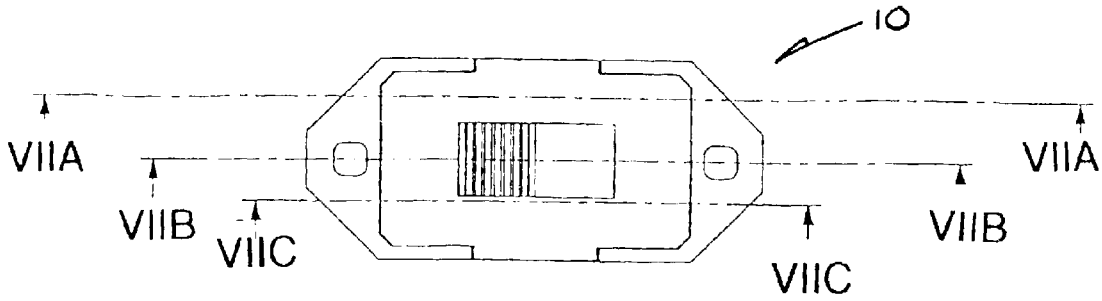
Figure 7A:
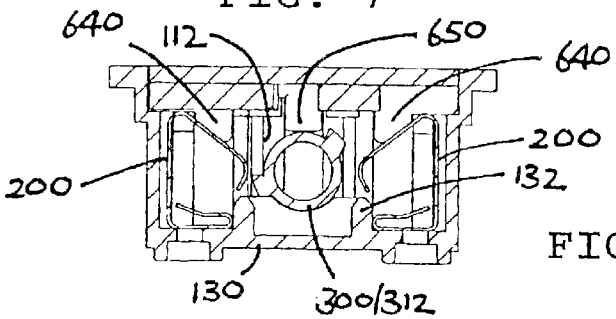
FIGS. 7A to 7C are cross-sectional side views taken along lines VIIA-VIIA, VIIB-VIIB and VIIC-VIIC of the electrical switch of FIG. 7.
Figure 7B:
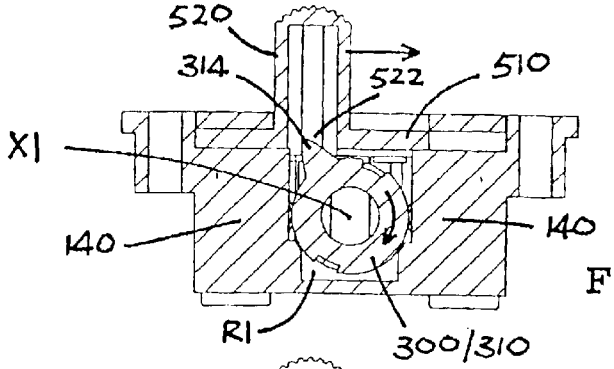
Figure 7C:
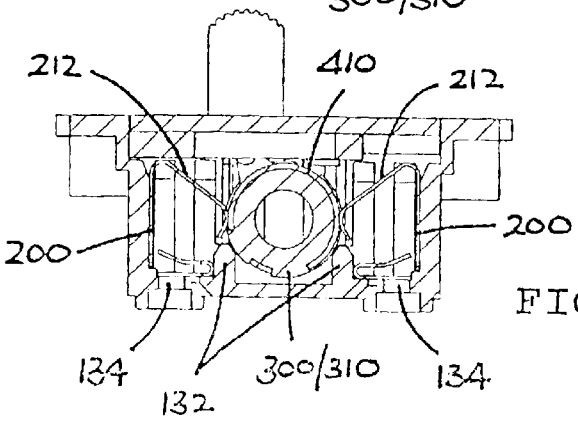
Figure 8:
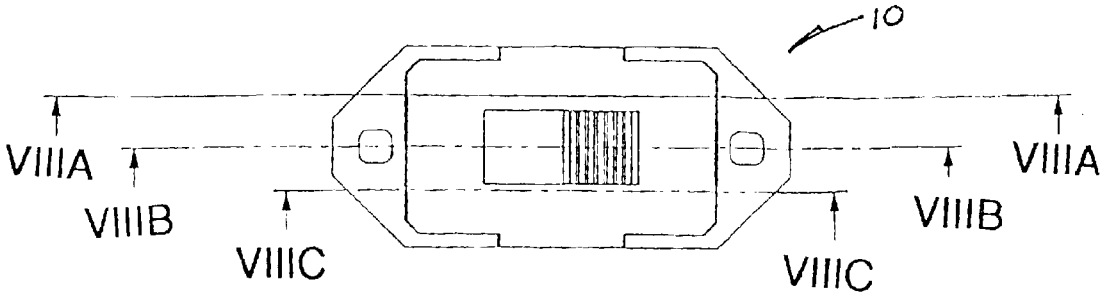
Figure 8A:
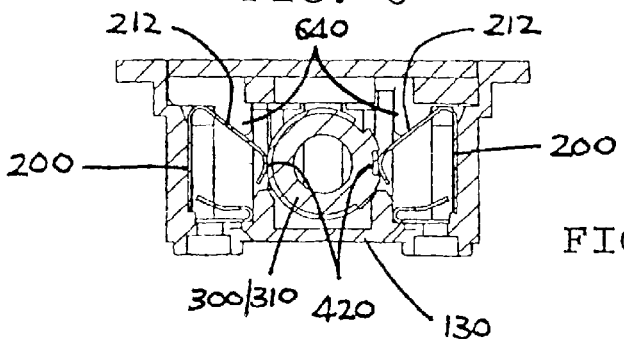
FIGS. 8A to 8C are cross-sectional side views taken along lines VIIIA-VIIIA, VIIIB-VIIIB, and VIIIC-VIIIC of the electrical switch of FIG. 8.
Figure 8B:
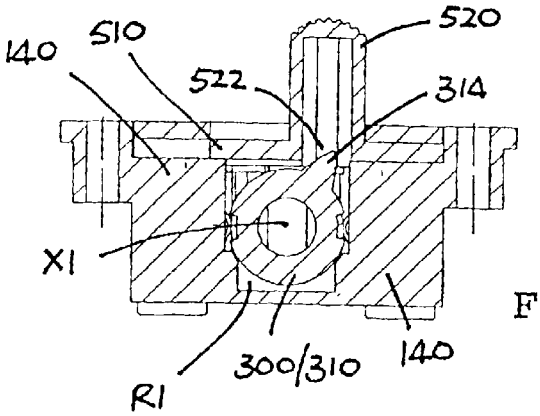
Figure 8C:
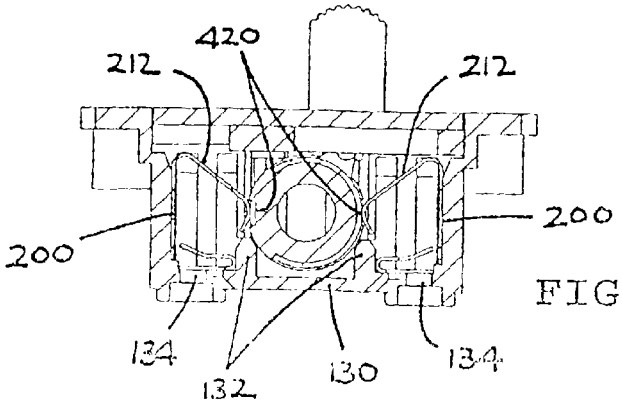

The actuator 500 is lowered into the housing 100 until its base plate 510 rests on the partition 140 (FIG. 3-6). The knob 520 is aligned with the switching arm 314 such that its opening 522 encloses and engages with the arm 314 through a sliding hinge connection (FIG. 7B). Finally, the lid 600 is inserted to close the housing 100 (FIG. 3-8).

The lid 600 has a generally flat channel-shaped lid body 610 facing downwards, which in turn has an oblong central aperture 620 allowing the actuator knob 520 to project upwards when the lid 600 closes the housing 100. There are four lateral tongues 630 and four depending triangular lugs 640 at respective corners of the lid body 610, and a rectangular lug 650 depending centrally from each longer side thereof. The tongues 630 snapfit with the holes 114 of the housing 100 to secure the lid 600 closed. The triangular lugs 640 maintain the corresponding fixed contacts 200 in position by engaging their inclined upper sections 212. The rectangular lugs 650 obstruct the upper open ends of the slots 112 to keep the switching member 300 in place.

The lid body 610 has a pair of depending flanges 612 extending along its longer sides. Centrally on its inner side, each flange 612 is formed with a pair of indentations 614 separated by a round flat triangular bump 616. While the lid 600 is closed, the base plate 510 of the actuator 500 is located in the channel of the lid body 610 as a sliding fit, with one of the two indentations 614 on each side accommodating the corresponding protuberance 514.

Figure 9A:
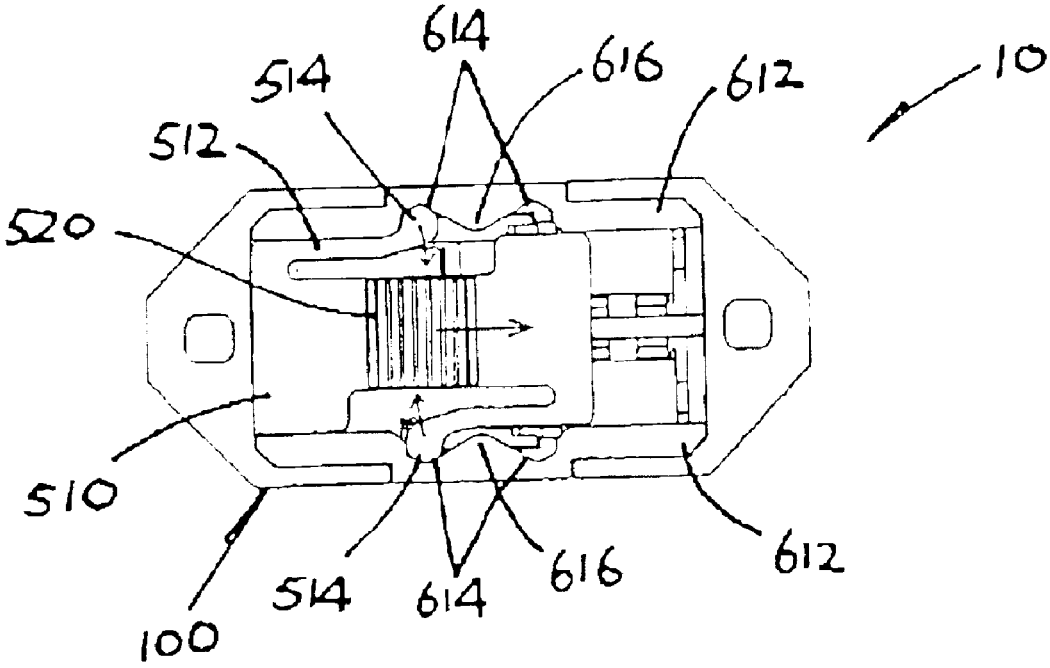
FIGS. 9A and 9B are broken top plan views of the electrical switch of FIG. 1 in the first and second switching positions respectively.
Figure 9B:
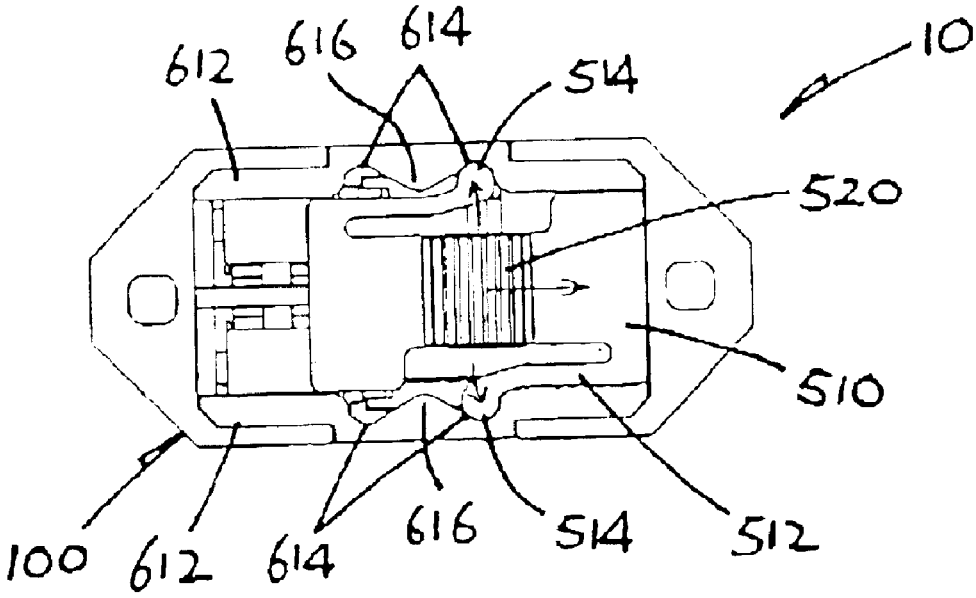

The actuator 500 is movable by a force applied to its knob 520 to slide in opposite directions longitudinally of the housing 100 for angularly reciprocating the switching member 300, each between two distinct stable switching positions. Such positions of the actuator 500, and hence those of the switching member 300, are determined by the indentations 614 of the lid 600 selectively engaged by the associated protuberance 514. During sliding of the actuator 500, each protuberance 514 slides from one indentation 614 (FIG. 9A) to the other, riding in transit past the middle bump 616 by receding against inherent resilience of the relevant finger 512 that forces the protuberance 514 into the upstream indentation 614 (FIG. 9B). The two switching positions of the switching member 300 are separated by an angle of 90°.

The resilient action provided by the fingers 512 to define the switching positions takes place in opposite horizontal directions transversely of the housing 100, which is perpendicular to the directions of the moving/fixed contact action as described above. For this reason, the positioning force does not affect, nor have any bearing on, the contact pressure that is often critical or predetermined within a small tolerance. Accordingly, positioning of the actuator 500 (and hence the switching ember 300) can be designed or implemented without placing too much weight on the contact making/breaking action, for optimum smoothness and crispiness in feel.

Figure 5A:
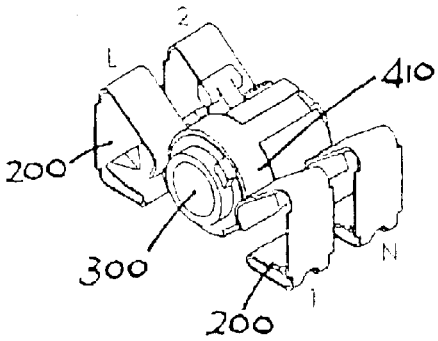
FIGS. 5A to 5C are opposite perspective views and a schematic view showing the moving and fixed contacts of the electrical switch of FIG. 1 in a first switching position.
Figure 5B:
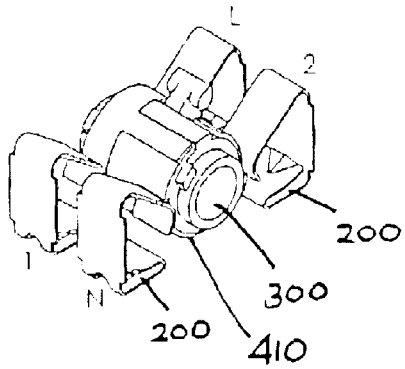

The four fixed contacts 200 are arranged with two on one side of the switching member 300 and the other two on the opposite side thereof. In the first switching position (FIGS. 5A to 5C), the cross limb 410 of each moving contact 400 electrically inter-connects a respective pair of the fixed contacts 200—"2 to N" and "L" to "1" as shown—on opposite sides of the switching member 300. In the second switching position (FIGS. 6A to 6C), the central limb 420 of each moving contact 400 short-circuits a respective pair of the fixed contacts 200—"2" to "L" and "N to 1" as shown—on the same side of the switching member 300.

The second position (FIG. 6C) represents a changeover in connection from the first position (FIG. 5C), or vice versa. In the first position, the fixed contacts 200 of each interconnected pair—"2 and N" or "L" and "1" as shown—are directly opposite or aligned with each other.

As is generally known in the art, it is possible to have each pair of diagonally opposite contacts inter-connected as one of the two changeover connections. Thus, in a different embodiment, the fixed contacts 200 of FIG. 5C may be cross connected as "2" to "1" and "L" to "N". This can be accomplished by modifying the moving contacts 400 for example to have a rectangular Z-shape, with the central segment extending axially along the cylindrical switching member and the two end segments extending slightly over 90° in opposite directions round respective ends of the switching member. The central segment alone serves to connect the two fixed contacts on the same side of the switching member, and in conjunction with both end segments to connect two fixed contacts on diagonally opposite sides of the switching member.

Figure 5C:
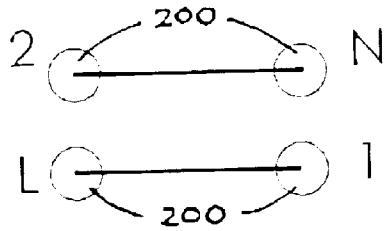
Figure 6A:
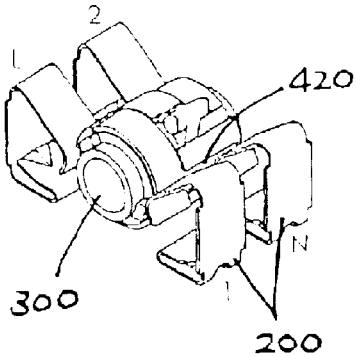
FIGS. 6A to 6C are opposite perspective views and a schematic view corresponding to FIGS. 5A to 5C, showing the moving and fixed contacts in a second switching position.
Figure 6B:
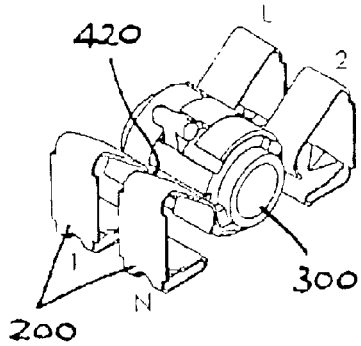
Figure 6C:
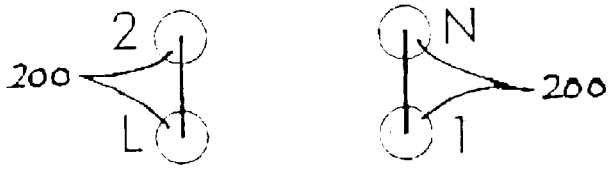

It is also envisaged that each moving contact may consist of two separate parts, with the first part used in one changeover connection (c.f. FIG. 5C) and the second part coming into operation for the other connection (c.f. FIG. 6C).

The electrical switch 10 has just sufficient number, i.e. four, of switch terminals (equivalent to fixed contacts 200) as normally required for basic changeover connection and switching. No terminals are wasted as compared with the prior art, and in the absence of redundant terminals the switch 10 can be made relatively shorter. The use of a rotary switching member 300 (that supports moving contacts 400) in a slide switch 10 is unique. The switching angle of the switching member 300, i.e. 90° in the described embodiment, is a primary factor to the sliding distance of the actuator 500, and this angle can readily be adjusted by changing the angular position of contact between the moving and the fixed contacts.

The subject switch may include more than four fixed contacts 200, such as six arranged in two rows, to perform a more complicate changeover switching action. It is envisaged that that the switch of the subject invention can be designed to perform any other types of switching actions, such as simple switching on and off, by for example changing the shape or configuration of the moving contacts 300.

The invention has been given by way of example only, and various other modifications of and/or alterations to the described embodiment may be made by persons skilled in the art without departing from the scope of the invention as specified in the appended claims.

What is claimed is:

1. An electrical slide switch comprising:

a housing, a plurality of fixed contacts located in the housing, a switching member supported in the housing for reciprocating rotary movement about an axis, at least one moving contact supported by the switching member for movement into and out of contact with the fixed contacts, and an actuator supported by the housing for sliding movement of the switching member, wherein the actuator slides in a direction substantially perpendicular to the axis.

2. An electrical slide switch comprising:

a housing, a plurality of fixed contacts located in the housing, a switching member supported in the housing for reciprocating rotary movement about an axis, at least one moving contact supported by the switching member for movement into and out of contact with the fixed contacts, and an actuator supported by the housing for sliding movement of the switching member, wherein the switching member has a substantially cylindrical body that is pivotable about the axis and that includes a lateral projection engaged by the actuator, and the actuator includes an aperture in which the projection is slidably engaged.

3. An electrical slide switch comprising:

a housing, a plurality of fixed contacts located in the housing, a switching member supported in the housing for reciprocating rotary movement about an axis, at least one moving contact supported by the switching member for movement into and out of contact with the fixed contacts, wherein the switching member has a substantially cylindrical body pivotable about the axis, and the moving contact extends over an angle exceeding 180° around the body, gripping the body, and an actuator supported by the housing for sliding movement of the switching member.

4. An electrical slide switch comprising:

a housing, a plurality of fixed contacts located in the housing, a switching member supported in the housing for reciprocating rotary movement about an axis, at least one moving contact supported by the switching member for movement into and out of contact with the fixed contacts, wherein the switching member has a substantially cylindrical surface around the axis, and the moving contact is located in that cylindrical surface and lies substantially flush with the cylindrical surface for contact with the fixed contacts, and an actuator supported by the housing for sliding movement of the switching member.

5. An electrical slide switch comprising:

a housing, four fixed contacts located in the housing, a switching member supported in the housing for reciprocating rotary movement about an axis, two of the fixed contacts being located on a first side of the switching member and two of the fixed contacts being located on a second side, opposite the first side, of the switching member, and including two of the moving contacts supported on the switching member, at least one moving contact supported by the switching member for movement into and out of contact with the fixed contacts, wherein each moving contact has a first part for electrically inter-connecting a respective pair of the fixed contacts on opposite sides of the switching member in a first position and includes a second part for electrically inter-connecting a respective pair of the fixed contacts on the same side of the switching member in a second position, and an actuator supported by the housing for sliding movement of the switching member.

6. The electrical slide switch as claimed in claim 5, wherein the switching member has a substantially cylindrical body having opposite ends and pivotable about the axis, and the first part of each moving contact extends partially around the body and the second part extends from a first end to a second end, opposite the first end, of the body.

7. The electrical slide switch as claimed in claim 6, wherein the first and second parts of each moving contact, together, are substantially T-shaped.

8. An electrical slide switch comprising:

a housing, a plurality of fixed contacts located in the housing, a switching member supported in the housing for reciprocating rotary movement about an axis, at least one moving contact supported by the switching member for movement into and out of contact with the fixed contacts, and an actuator supported by the housing for sliding movement of the switching member, wherein each fixed contact comprises a resiliently deformable strip having a first end for contact with the moving contact and a second end for connection with an electrical cable, the second end being folded to form a clamp with an adjacent part of the strip for automatically clamping an end of the cable upon insertion.

9. The electrical slide switch as claimed in claim 8, wherein the contact strip has a generally right-angled triangular configuration, having an inclined upper section including the first end, a lower section including the second end, and a middle section including the adjacent part of the stop.

10. An electrical slide switch comprising:

a housing, a plurality of fixed contacts located in the housing, a switching member supported in the housing for reciprocating rotary movement about an axis, at least one moving contact supported by the switching member for movement into and out of contact with the fixed contacts, and an actuator supported by the housing for sliding movement of the switching member, wherein the housing has a part engaging the actuator, and one of the actuator and the part of the housing includes a protuberance and the other of the actuator and the part of the housing includes a series of indentations, the protuberance being slidably and resiliently engageable, selectively, with the indentations to define respective distinct stable positions of the actuator.

11. The electrical slide switch as claimed in claim 10, wherein the protuberance is engageable with the indentations in a direction that is substantially perpendicular to the direction in which the moving contact contacts the fixed contacts.

12. The electrical slide switch as claimed in claim 11, wherein the moving contact contacts the fixed contacts substantially along an imaginary plane, and the protuberance is engageable with the indentations in a direction substantially perpendicular to the imaginary plane.

13. The electrical slide switch as claimed in claim 10, wherein the actuator includes two of the protuberances on opposite sides of the actuator, and the part of the housing includes two series of the indentations on opposite sides of the part of the housing for selective engagement by the corresponding protuberances.

14. The electrical slide switch as claimed in claim 13, wherein the part of the housing has a pair of depending flanges, each flange including on an inner side a corresponding series of the indentations.

15. The electrical slide switch as claimed in claim 10, wherein the protuberance is resiliently biassed into engagement, selectively, with the series of indentations.

16. The electrical slide switch as claimed in claim 15, wherein the protuberance comprises a free end of a finger that is resiliently deflectable.

17. The electrical slide switch as claimed in claim 16, wherein the actuator includes two of the fingers on opposite sides of the actuator and extending in opposite directions along the actuator.

18. An electrical changeover switch comprising:

a housing, a switching member supported in the housing for reciprocating movement, four fixed contacts located in the housing with two of the fixed contacts adjacent a first side of the switching member and two of the fixed contacts adjacent a second side, opposite the first side, of the switching member, two moving contact means supported by the switching member for movement into and out of contact with the fixed contacts, and an actuator supported by the housing for sliding movement of the switching member, wherein each moving contact means has a first part for electrically interconnecting a respective pair of the fixed contacts on opposite sides of the switching member, in a first position, and includes a second part for electrically inter-connecting a respective pair of the fixed contacts on the same side of the switching member, in a second position.

19. The electrical changeover switch as claimed in claim 18, wherein the switching member is supported for reciprocating rotary movement about an axis.

20. The electrical changeover switch as claimed in claim 18, wherein the actuator slides substantially linearly.

21. An electrical slide switch comprising:

a housing, a plurality of fixed contacts located in the housing, a switching member supported in the housing for reciprocating movement, at least one moving contact movable by the switching member to move into and out of contact with the fixed contacts in a first direction, and an actuator supported by the housing for sliding movement moving the switching member, the housing having a part engaging the actuator, wherein one of the actuator and the part of the housing includes a protuberance and the other of the actuator and the part of the housing includes a series of indentations, the protuberance being slidably and resiliently engageable, selectively, with the indentations to define respective distinct stable positions of the actuator, and the protuberance is engageable with the indentations in a second direction that is substantially perpendicular to the first direction.

22. The electrical slide switch as claimed in claim 21, wherein the protuberance is engageable with the indentations in a direction that is substantially perpendicular to the direction in which the moving contact contacts the fixed contacts.

23. The electrical slide switch as claimed in claim 22, wherein the moving contact contacts the fixed contacts substantially along an imaginary plane, and the protuberance is engageable with the indentations in a direction substantially perpendicular to the imaginary plane.

24. The electrical slide switch as claimed in claim 21, wherein the actuator includes two of the protuberances on opposite sides of the actuator, and the part of the housing includes two of the series of indentations on opposite sides of the part of the housing for selective engagement by the corresponding protuberances.

25. The electrical slide switch as claimed in claim 24, wherein the part of the housing has a pair of depending flanges, each flange including on an inner side the corresponding series of indentations.

26. The electrical slide switch as claimed in claim 21, wherein the protuberance is resiliently biassed into engagement, selectively, with the series of indentations.

27. The electrical slide switch as claimed in claim 26, wherein the protuberance comprises a free end of a finger that is resiliently deflectable.

28. The electrical slide switch as claimed in claim 27, wherein the actuator includes two of the fingers on opposite sides of the actuator and extending in opposite directions along the actuator.

* * * * *